US010058720B2

(12) United States Patent
Weinmeister

(10) Patent No.: US 10,058,720 B2
(45) Date of Patent: Aug. 28, 2018

(54) MULTI-USE FIREFIGHTING TOOL

(71) Applicant: Ronald L. Weinmeister, Fort Collins, CO (US)

(72) Inventor: Ronald L. Weinmeister, Fort Collins, CO (US)

( * ) Notice: Subject to any disclaimer, the term of this patent is extended or adjusted under 35 U.S.C. 154(b) by 283 days.

(21) Appl. No.: 15/162,298

(22) Filed: May 23, 2016

(65) Prior Publication Data

US 2016/0263408 A1 Sep. 15, 2016

Related U.S. Application Data

(63) Continuation-in-part of application No. 14/066,275, filed on Oct. 29, 2013, now Pat. No. 9,345,912.

(51) Int. Cl.

| | |
|---|---|
| ***A62B 3/00*** | (2006.01) |
| ***B25B 13/06*** | (2006.01) |
| ***B25B 13/50*** | (2006.01) |
| ***B66F 15/00*** | (2006.01) |

(52) U.S. Cl.

CPC ..... *A62B 3/005* (2013.01); *B25B 13/065* (2013.01); *B25B 13/50* (2013.01); *B66F 15/00* (2013.01); *Y10T 29/49826* (2015.01)

(58) Field of Classification Search

CPC ..... A62B 3/005; B25B 13/065; B25B 13/50; B66F 15/00; Y10T 29/49826

See application file for complete search history.

(56) References Cited

U.S. PATENT DOCUMENTS

| | | | | |
|---|---|---|---|---|
| 165,984 | A | 7/1875 | Cosbey | |
| 1,749,103 | A | 3/1930 | Kortick | |
| 1,884,990 | A | 10/1932 | Funke | |
| 3,185,442 | A | 5/1965 | Hemphill | |
| 3,705,430 | A | 12/1972 | Ziaylek, Jr. | |
| 4,465,113 | A | 8/1984 | Hillinger | |
| 4,926,558 | A | 5/1990 | Brace | |
| 5,095,623 | A | 3/1992 | Williams | |
| 6,367,107 | B1 | 4/2002 | Corsini | |
| 6,899,001 | B1 * | 5/2005 | Sanders | B25G 1/04 81/125 |
| D591,578 | S | 5/2009 | Harpell | |
| 7,634,830 | B2 | 12/2009 | Ryan | |
| 7,637,183 | B2 * | 12/2009 | Alvarado | B25B 13/50 81/120 |
| D617,624 | S | 6/2010 | Tygh | |
| 7,726,713 | B2 | 6/2010 | Oleksia | |
| 7,735,172 | B2 | 6/2010 | Newton et al. | |
| 7,774,882 | B2 | 8/2010 | Liou | |
| 7,845,254 | B2 | 12/2010 | Lionel | |
| 7,900,538 | B2 | 3/2011 | Phillips et al. | |
| D637,462 | S | 5/2011 | Glynn et al. | |

(Continued)

OTHER PUBLICATIONS

"Halligan bar," Wikipedia, last modified May 3, 2013, retrieved from http://en.wikipedia.org/wiki/Halligan_bar, 2 pages.

(Continued)

*Primary Examiner* — David B Thomas

(74) *Attorney, Agent, or Firm* — Talus Law Group LLC

(57) ABSTRACT

The present invention provides a multi-use firefighting tool. The tool may be used as a stand-alone tool or as a supplement to existing tools. An additional aspect of the present invention is to provide a multi-use tool configured to enable, among other things, forcible entry and valve opening/closing.

21 Claims, 13 Drawing Sheets

(56) References Cited

U.S. PATENT DOCUMENTS

| | | | | |
|---|---|---|---|---|
| D644,083 | S | 8/2011 | Dapkins, Jr. et al. | |
| D655,142 | S | 3/2012 | Glynn et al. | |
| 8,127,387 | B2 | 3/2012 | Tygh | |
| 8,550,437 | B2 | 10/2013 | Liou | |
| 8,794,597 | B1 | 8/2014 | Ingesson et al. | |
| D726,522 | S | 4/2015 | Wells | |
| 9,345,912 | B2 | 5/2016 | Wells | |
| 9,649,752 | B1 * | 5/2017 | Garrison | B25B 13/463 |
| 2002/0134971 | A1 | 9/2002 | Christensen | |
| 2003/0102468 | A1 | 6/2003 | Selzer | |
| 2004/0261188 | A1 * | 12/2004 | Mathis | B25D 1/00 7/145 |
| 2006/0075572 | A1 * | 4/2006 | Young | B25B 13/48 7/138 |
| 2009/0000097 | A1 | 1/2009 | Dapkins, Jr. et al. | |
| 2010/0299843 | A1 | 12/2010 | Dapkins, Jr. et al. | |

OTHER PUBLICATIONS

"Product Catalog," On Scene Solutions, 2013, 5 pages.
Notice of Allowance for U.S. Appl. No. 29/460,172, dated Nov. 28, 2014, 7 pages.
Official Action for U.S. Appl. No. 14/066,275, dated Sep. 15, 2015, 7 pages.
Notice of Allowance for U.S. Appl. No. 14/066,275, dated Jan. 13, 2016, 5 pages.
U.S. Appl. No. 29/568,291, filed Jun. 16, 2016, Weinmeister.

* cited by examiner

DETAIL A
SCALE 2 : 1

DETAIL B
SCALE 2 : 1

12/13

7.45
.63
R.10
.50
0.59 X 45°
Ø .375 THRU
.19 X 45°
1.48
3.83
3.0°
.33
R5.22
R.02
.47
2.00
.305
200°
1.88
.510
R.25
1.00
0.08 X 45°

MULTI-USE FIREFIGHTING TOOL

CROSS REFERENCE TO RELATED APPLICATIONS

This application is a continuation-in-part of co-pending U.S. patent application Ser. No. 14/066,275, filed Oct. 29, 2013, which is incorporated herein by reference in its entirety.

This application incorporates by reference in its entirety U.S. Design Pat. No. D726,522, issued Apr. 14, 2015.

FIELD OF THE INVENTION

Embodiments of the present invention are generally related to a multi-use firefighting tool, and, in particular, to an apparatus and method for forcible entry as a stand-alone tool or as a supplement to existing tools.

BACKGROUND OF THE INVENTION

Firefighters are routinely confronted with unpredictable situations requiring the assistance of tools. For example, a locked door may be encountered preventing inspection of a particular room, or an electrical panel may be rusted shut. In such situations, firefighting tools may facilitate or enable forcible entry or access by wedging, prying or breaking. Other tools may function to open or close a fire hydrant or a gas meter, and rip into walls to search for fire sources. Frequently, firefighters carry multiple tools to serve a variety of needs, in the hope that the tools will adapt to the immediate need and not require the added time and risk of returning to a staging area to retrieve an additional tool. A common default set of tools, or "set of irons," for a firefighter to carry are a halligan tool and a flat-head axe.

Traditional multi-use firefighting tools have been developed to combine common tool capabilities. In practice, while some multi-use tools have beneficial uses, they are not widely used, because, for example, they do not align or engage with the common set of irons carried by firefighters or are cumbersome to use.

Some efforts have been made to improve the tools for firefighting application. For example, U.S. Pat. No. 5,095,623 to Williams ("Williams") discloses a firefighting tool having a flat blade with a pointed leading end for piercing through structural panels, stop teeth for engaging a structural panel that has been pierced, and rip teeth for sawing through structural panels when the tool is reciprocated along its longitudinal axis. The stop teeth are positioned at an angle relative to the rip teeth. The tool may be maintained in an overhead configuration when used to remove ceiling panels because the angle of the stop teeth provides a hooking action enabling the ceiling to support the tool weight. Because the stop teeth defeat inadvertent withdrawal of the blade, the firefighter need not make multiple penetrations of ceiling panels or other structural members being removed by the tool. However, Williams fails to teach several novel features of the present invention, including a multi-use tool configured to enable forcible entry and valve opening/closing, and adapted to supplement a firefighting halligan tool. Williams is incorporated by reference in its entirety.

U.S. Pat. No. 7,726,713 to Oleksia ("Oleksia") discloses a multi-use tool having a generally J-shaped hook structure with a top portion, a middle shank portion and a curved bottom portion. The top portion has a loop to which a rope, life-line or escape line can be fastened. The curved bottom portion extends to a beveled tip. The multi-use tool also has a protruding member that extends from the curved bottom portion and has a substantially flat top surface and a substantially flat bottom surface. However, Oleksia fails to teach several novel features of the present invention, including a multi-use tool configured to enable forcible entry and valve opening/closing, and adapted to supplement a firefighting halligan tool. Oleksia is incorporated by reference in its entirety.

U.S. Pat. No. 3,705,430 to Ziaylek, Jr. ("Ziaylek") discloses a forcible entry tool having a shank portion, a tail portion and a head portion. The head consists of a spike extending normal to the axis of the shank and wedge and wrench portions extending mutually opposite from each other along a line extending generally normal to both the extension of the shaft and that of the spike. The wedge and wrench portions consist of approximately equal masses so that when an impact is applied to an object by the spike portion. Any lateral turning moment about the spike is minimized. The wrench is formed as an extension of the wedge portion and presents an arcuate upper surface extending between the two so that when the wedge is used, a greater fulcrum distance is provided. Furthermore, in using the wrench portion, both the shank portion and the wedge may be utilized as a dual handle system for applying additional torque to a hose coupling and the like. The shank may be formed to bend away from the side presenting the wrench to facilitate the application of torque to a hose coupling when using the wrench. However, Ziaylek fails to teach several novel features of the present invention, including a multi-use tool configured to enable forcible entry and valve opening/closing, and adapted to supplement a firefighting halligan tool. Ziaylek is incorporated by reference in its entirety.

Some efforts have been made to provide firefighting tools that feature multiple uses. For example, U.S. Pat. No. 7,845,254 to Lionel ("Lionel") discloses a firefighter pocket tool combining the functional features of several traditional tools (slip groove pliers of the curved jaw type, 6 in 1 screwdriver, spanner wrench, gas shut-off tool and a striking tool) onto a shared single structure. The tool comprises a pair of slip groove pliers each having a jaw portion, a joint portion and a handle portion, a pivotal bolt, nut and spring member. A protrusion on the upper rear portion of the pliers' upper jaw's head forms a striking surface and a hook and claw which can be used as a spanner for rocker lug type and similar fire hose couplings. A gas shut off loop can be used as a finger guard when the tool is being used as a striking implement. However, Lionel fails to teach several novel features of the present invention, including a multi-use tool configured to enable forcible entry and valve opening/closing, and adapted to supplement a firefighting halligan tool. Lionel is incorporated by reference in its entirety.

U.S. Pat. No. 8,127,387 to Tygh ("Tygh") discloses a manually held firefighting tool with an elongated staff section comprising working members at each end. The first working member has a claw element and a spike element, each extending perpendicularly to the longitudinal axis of the staff section and protruding from the staff section in opposite directions. The second working member extends from the second end of the staff section and has a U-shaped yoke element supporting an arcuate cross bar element positioned parallel to the longitudinal axis of the staff section. The second working member has its own claw element at one end and a spike element at the other end. A flat bar element is affixed perpendicularly to the cross bar element between its two ends. However, Tygh fails to teach several novel features of the present invention, including a multi-use tool configured to enable forcible entry and valve opening/closing, and adapted to supplement a firefighting halligan tool. Tygh is incorporated by reference in its entirety.

U.S Patent Application Publication No. US 2004/0261188 to Mathis ("Mathis") discloses a combination tool for use in fighting fires, search and rescue, forcible entry, auto extrications, and salvage and overhaul. An axe/hammer head member is attached to an elongated handle pry bar of various sizes. The handle pry bar forms itself on either side of the axe/hammer head acting as a chop stop for both axe/hammer member. The pry bar member provides a water/gas shut off tool as well as a pry tool. The axe underside is a 3-in-1 tool providing a hydrant wrench, windshield and dry wall cutter. The cutters are used when the axe is supplanted past the dry wall or windshield and pulled. The hammer underside provides a spanner wrench for hoses and the common stortz coupling on fire trucks. However, Mathis fails to teach several novel features of the present invention, including a multi-use tool configured to enable forcible entry and valve opening/closing, and adapted to supplement a firefighting halligan tool. Mathis is incorporated by reference in its entirety.

Finally, some efforts have been made to provide firefighting tools that engage other firefighting tools. U.S. Pat. No. 6,367,107 to Corsini ("Corsini") discloses a striking tool for interlocking with a bar-like tool having a fork end and/or a pike end. The striking tool uses two retaining features for retaining a bar-like tool. The pike can be replaced by or supplemented with an adz, or any other type of extrusion. The bar-like tool may be a halligan tool. The striking tool is preferably an axe having a handle and a striking head anchored to the handle. One of the bar-like-tool retaining features is located on the striking head and the other retaining feature is located on the handle. The two tools are detachably interlocked for storage or carrying purposes. However, Corsini fails to teach several novel features of the present invention, including a multi-use tool configured to enable forcible entry and valve opening/closing, and adapted to supplement a firefighting halligan tool. Corsini is incorporated by reference in its entirety.

What is needed is a multi-use tool configured to enable forcible entry and valve opening/closing.

SUMMARY OF THE INVENTION

It is one aspect of the present invention to provide a multi-use firefighting tool. The tool may be used as a stand-alone tool or as a supplement to existing tools. An additional aspect of the present invention is to provide a multi-use tool configured to enable, among other things, forcible entry and valve opening/closing. Further, the tool may be used to supplement a firefighting halligan tool.

In one embodiment of the invention, a fighting tool is disclosed, the tool comprising: a body having an upper surface, a second surface, a pair of lateral surfaces, a vertical aperture and a lateral cavity, the vertical aperture extending through the body between the upper and second surfaces, the lateral cavity extending through the body between the pair of lateral surfaces; and a wedge interconnected with the body comprising at least a pair of edges defining a slot.

In another embodiment of the invention, a hallagan tool and firefighting tool assembly is disclosed, the assembly comprising: a body having an upper surface, a second surface, a pair of lateral surfaces, a vertical aperture and a lateral cavity, the lateral cavity extending through the body between the pair of lateral surfaces, the vertical aperture adapted to engage a pick of a hallagan tool and the lateral cavity adapted to engage an adz of the hallagan tool, the pick and the adz at a distal end of the hallagan tool; and a firefighting tool interconnected to the body, the firefighting tool including a wedge portion comprising at least a pair of edges defining a slot; wherein the firefighting tool extends from the distal end of the halligan when the firefighting tool is engaged with one of the pick and the adz of the halligan tool.

In yet another embodiment of the invention a method of using a hallagan tool and firefighting tool assembly is disclosed, the method comprising: providing a firefighting tool, the tool comprising: a body having an upper surface, a second surface, a pair of lateral surfaces, a vertical aperture and a lateral cavity, the lateral cavity extending through the body between the pair of lateral surfaces, the vertical aperture adapted to engage a pick of a hallagan tool and the lateral cavity adapted to engage an adz of the hallagan tool, the pick and the adz at a distal end of the hallagan tool; and a wedge portion comprising at least a pair of edges defining a slot; providing a halligan tool; interconnecting the halligan tool with the firefighting tool by one of: 1) the pick of the halligan tool with the tool vertical aperture and 2) the adz of the halligan tool with the tool lateral cavity; and engaging an external surface with the hallagan tool and firefighting tool assembly to at least one of force-entry, pry, wedge, strike, hammer, twist and destructively transfer energy.

In another embodiment of the invention, a firefighting tool is disclosed, the firefighting tool comprising: a body having a first end comprising a wedge and a second end comprising a slot and a horizontal aperture passing through the slot; a handle comprising a first end comprising a handle aperture, the handle first end configured to interconnect with the slot wherein the handle aperture aligns with the horizontal aperture to enable a pin to fit within the aligned handle aperture and horizontal aperture; and a socket comprising a first end configured to interconnect with the second end of the handle and a second end configured with a pentagonal aperture.

In yet another embodiment, a firefighting tool is disclosed, the firefighting tool comprising: a body having a first end configured with a wedge and a second end configured with a slot and a horizontal aperture passing through the slot; a handle comprising a first end configured with a handle aperture and configured to interconnect with the slot, wherein when the handle aperture is in alignment with the horizontal aperture a pin fitted within the aligned handle aperture and horizontal aperture secures the handle with the body; a socket comprising a first end configured to interconnect with the second end of the handle and a second end configured with a pentagonal aperture; and a connecting sleeve configured to engage the handle first end; wherein the pentagonal aperture is adapted to operate as a valve operating tool.

In another embodiment, a method of using a firefighting tool is disclosed, the method comprising: providing a firefighting tool, the tool comprising: a body having a first end comprising a wedge and a second end comprising a slot and a horizontal aperture passing through the slot; a handle comprising a first end comprising a handle aperture, the handle first end configured to interconnect with the slot wherein the handle aperture aligns with the horizontal aperture to enable a pin to fit within the aligned handle aperture and horizontal aperture; a socket comprising a first end configured to interconnect with the second end of the handle and a second end configured with a pentagonal aperture; and engaging an external surface with the firefighting tool assembly to at least one of force-entry, pry, wedge, strike, hammer, twist and destructively transfer energy.

The term "halligan tool," "halligan bar," "hallagan tool," "hallagan bar" or variations thereof refer to a multi-purpose firefighting tool consisting of a claw at one end, and a pick and adze at the other end.

The term "claw" and "fork" or variations thereof refer to a multi-prong element with an enclosed recess area.

The term "adze" or 'adz," "wedge" and/or "blade" or variations thereof refer to a generally tapered wedge-like element of rectangular cross-section.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIG. 1-9 depict various embodiments and features of the multi-purpose fire-fighting tool.

Figure 1:
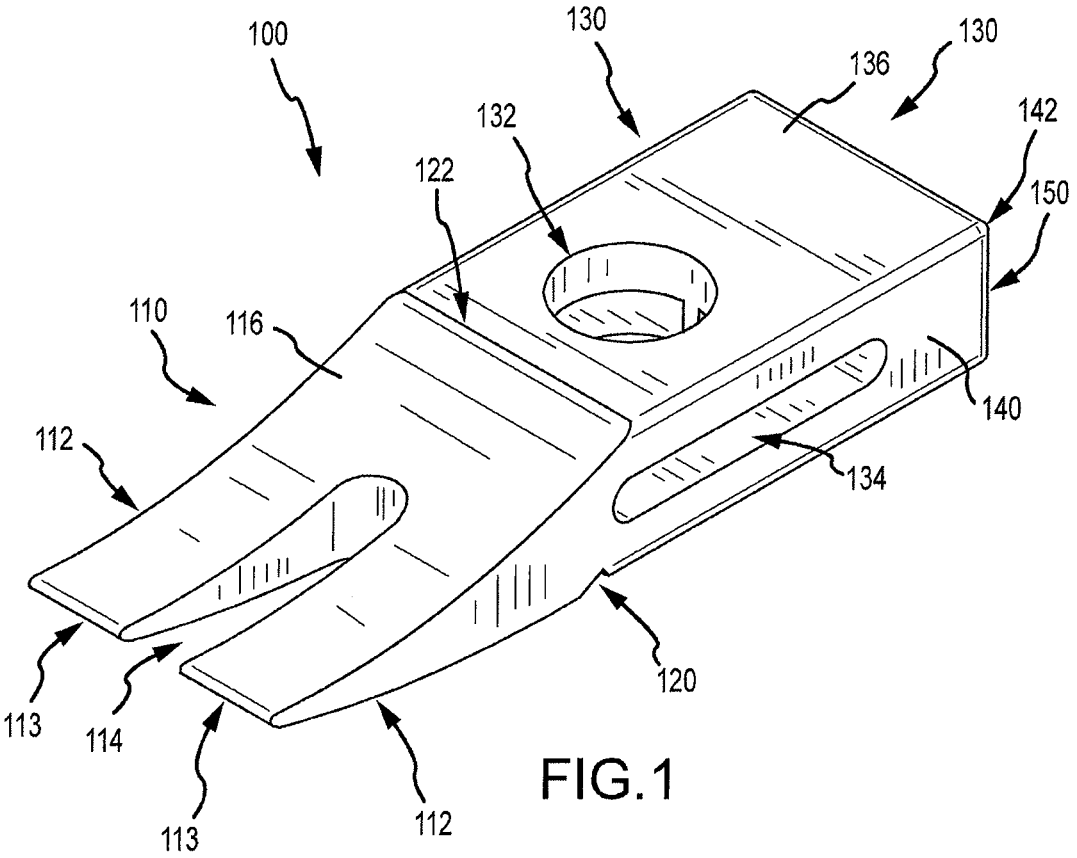
FIG. 1 depicts a front perspective view of the multi-use firefighting tool according to one embodiment of the present invention.

FIG. 1 depicts a perspective view and FIGS. 2A-D depict respective front, top, left side and cross-sectional views of the multi-use Firefighting Tool 100 according to one embodiment of the present invention. Referring to FIGS. 1 and 2A-D, the elements of the Firefighting Tool 100 are provided. Firefighting Tool 100 generally comprises Firefighting Tool Body 130 interconnected to a Firefighting Tool Wedge 110. The Firefighting Tool Body 130 comprises Firefighting Tool Body Vertical Aperture 132, Firefighting Tool Body Horizontal Cavity 134, Firefighting Tool Body First Surface 136, Firefighting Tool Body Second Surface 138, Firefighting Tool Body Lateral Surface 140, Firefighting Tool Body Edges 142 and Firefighting Tool Body Face 150. Firefighting Tool Wedge 110 comprises two Firefighting Tool Wedge Prongs 112, each comprising Firefighting Tool Wedge Prong Edge 113. Firefighting Tool Wedge Slot 114 comprises Firefighting Tool Wedge Slot Distal End 115, Firefighting Tool Wedge First Surface 116 and Firefighting Tool Wedge Second Surface 118. Firefighting Tool Wedge/Body Transition 122 is disposed between Firefighting Tool Body First Surface 136 and Firefighting Tool Wedge First Surface 116. Firefighting Tool Groove 120 is disposed between Firefighting Tool Body Second Surface 138 and Firefighting Tool Wedge Second Surface 118.

Figure 2B:
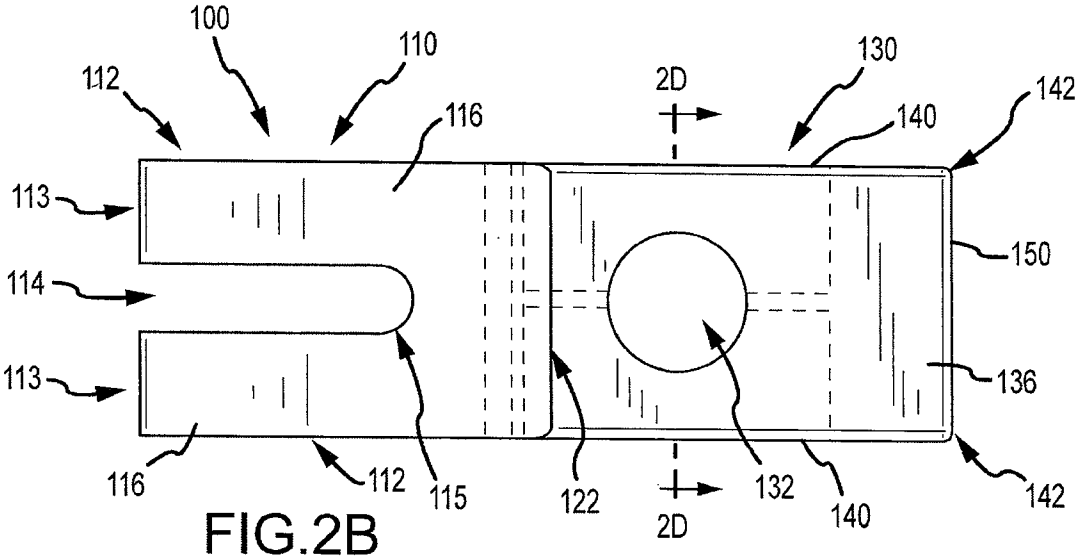
FIG. 2B depicts a top plan view of the multi-use firefighting tool of FIG. 1 according to one embodiment of the present invention.
Figure 2C:
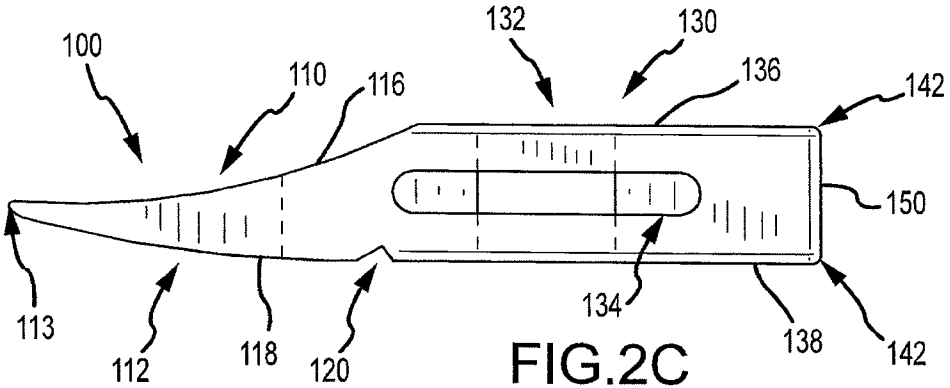
FIG. 2C depicts a left elevation view of the multi-use firefighting tool of FIG. 1 according to one embodiment of the present invention.
Figure 2A:
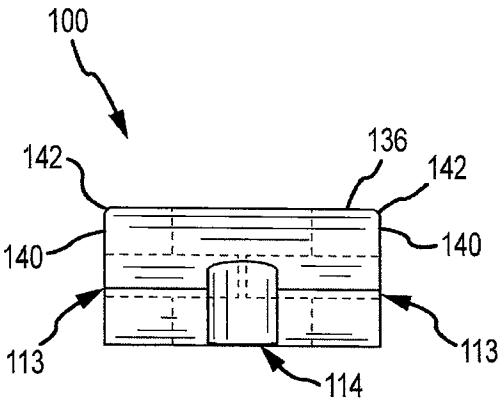
FIG. 2A depicts a front elevation view of the multi-use firefighting tool of FIG. 1 according to one embodiment of the present invention.
Figure 2D:
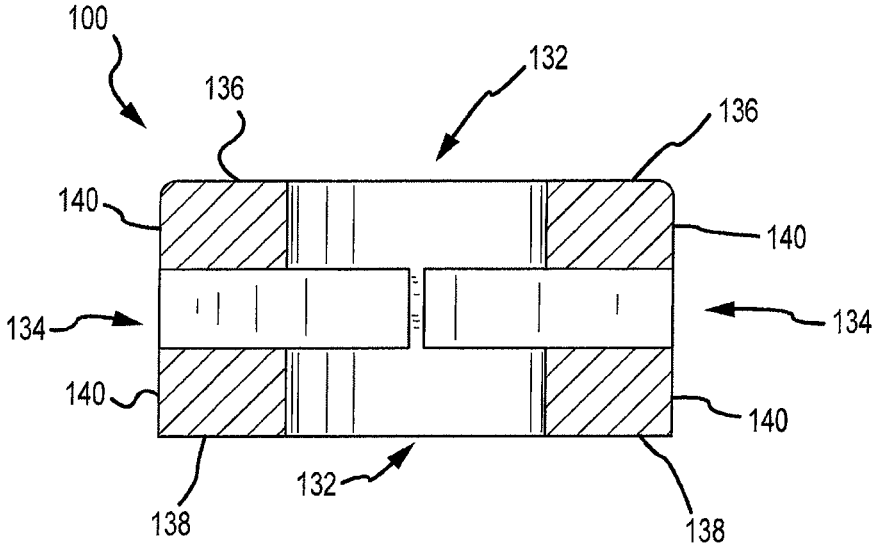
FIG. 2D depicts a cross-sectional view of Section 2D-2D of FIG. 2C.
Figure 3A:
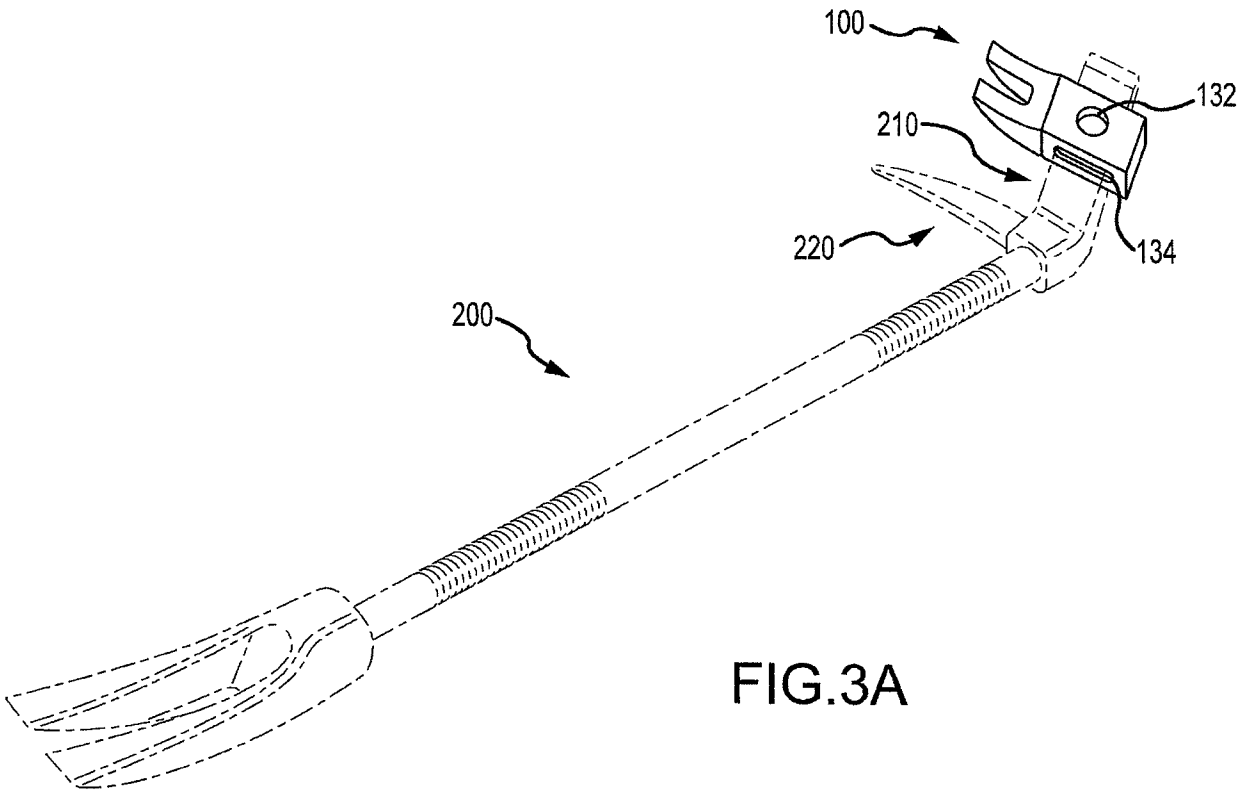
FIG. 3A depicts a front perspective view of the multi-use firefighting tool of FIG. 1 engaged with the adze of a halligan tool.
Figure 3B:
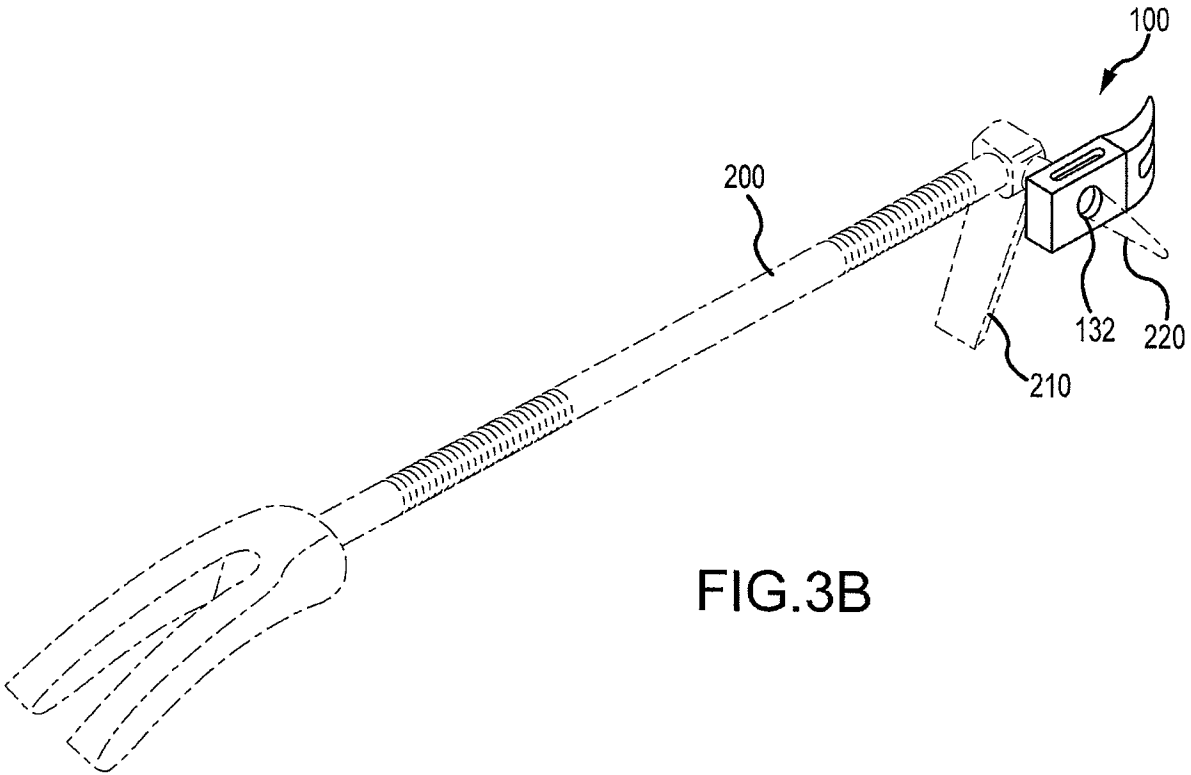
FIG. 3B depicts a front perspective view of the multi-use firefighting tool of FIG. 1 engaged with the pick of a halligan tool.
Figure 4A:
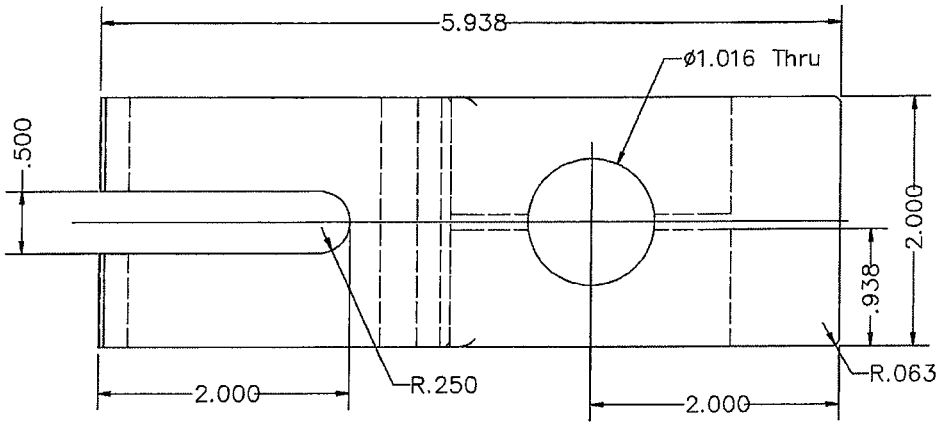
FIG. 4A illustrates a top plan view of an example construction of a particular embodiment of the multi-use firefighting tool—the drawing is to scale with dimensions in inches.
Figure 4B:
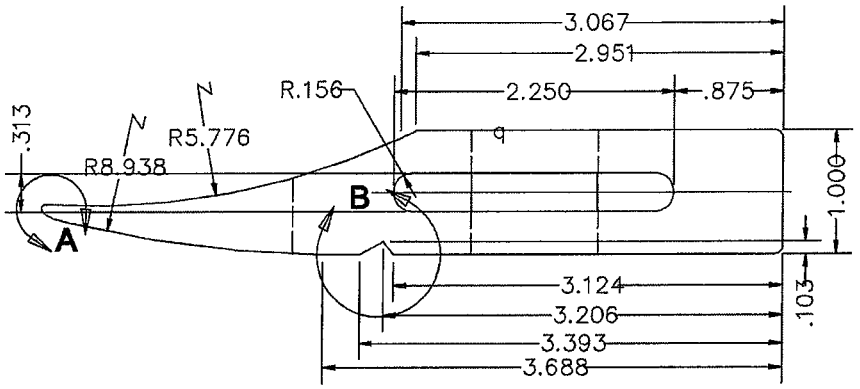
FIG. 4B illustrates a left elevation view of an example construction of a particular embodiment of the multi-use firefighting tool of FIG. 4A—the drawing is to scale with dimensions in inches.
Figure 4C:
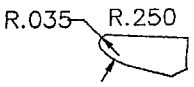
FIG. 4C illustrates a detailed view of Section A of FIG. 4B—the drawing is to scale.
Figure 4D:
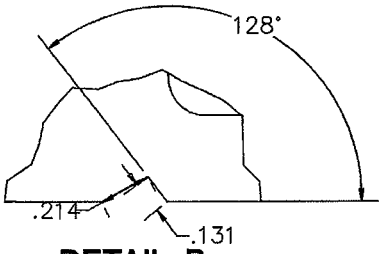
FIG. 4D illustrates a detailed view of Section B of FIG. 4B—the drawing is to scale.

Firefighting Tool Wedge First Surface 116 and Firefighting Tool Wedge Second Surface 118 are generally of a curved profile shape, as shown in FIG. 2C, and form two adjacent and symmetrical Firefighting Tool Wedge Prongs 112. The two Firefighting Tool Wedge Prongs 112 form a Firefighting Tool Wedge Slot 114 therebetween. The two Firefighting Tool Wedge Prongs 112 forming a Firefighting Tool Wedge Slot 114 may be used, for example, to engage and operate a valve, such as a gas meter valve or a fire hydrant valve. The opposing curved surfaces forming the two Firefighting Tool Wedge Prongs 112, i.e. Firefighting Tool Wedge First Surface 116 and Firefighting Tool Wedge Second Surface 118, may be used as a wedge tool. For example, the Firefighting Tool Wedge 110 portion may be inserted under a door to wedge it open or fix its position by placing the either the Firefighting Tool Wedge Second Surface 118 or the Firefighting Tool Wedge First Surface 116 facing the ground and inserting the Firefighting Tool Wedge Prong Edges 113 under the door. In a preferred use, the Firefighting Tool Wedge First Surface 116 is positioned facing the ground when used as a door stop; in such a configuration, the bottom of a door may lodge into the Firefighting Tool Groove 120 for a positive stop. The Firefighting Tool Wedge 110 portion may also be used for other wedging operations or functions, such as an over-the-hinge door wedge in which the Firefighting Tool Wedge Slot 114 of the Firefighting Tool Wedge 110 portion is placed over the door hinge.

Once the Firefighting Tool Wedge 110 portion is engaged in, for example, one of the above scenarios, the Firefighting Tool 100 may be further advanced or forced into or beyond its position solely by hand or through use of the Firefighting Tool Body Face 150. That is, the Firefighting Tool 100 may be struck at its Firefighting Tool Body Face 150 by, for example, a hammer, the flat-end of an axe, or a halligan tool. Similarly, additional or alternative leverage may be imparted to the Firefighting Tool 100 when positioned to function as a wedge by inserting a tool, such as a hallagan tool, into the Firefighting Tool Body Vertical Aperture 132 or the Firefighting Tool Body Horizontal Cavity 134. More specifically, the pick or spike end of a standard hallagan tool may be inserted into the Firefighting Tool Body Vertical Aperture 132 to increase leveraged wedging force of the Firefighting Tool 100 within the cavity in which it is inserted. Also, if the pick or spike end of a standard hallagan tool is inserted into the Firefighting Tool Body Vertical Aperture 132 and urged at an angle other than parallel to the Firefighting Tool Wedge 110 portion, a twisting force or tongue will be transferred to the Firefighting Tool Wedge 110. Such a twisting force is frequently useful in prying open entry ways.

Firefighting Tool Body Vertical Aperture 132 is configured to engage a standard pick or spike end of a hallagan tool. In some embodiments, one or both edges of Firefighting Tool Body Vertical Aperture 132, at one or both of Firefighting Tool Body First Surface 136 and Firefighting Tool Body Second Surface 138, is tapered or rounded.

Firefighting Tool Wedge Slot 114 is configured to engage a standard adze end of a hallagan tool. In the embodiment of FIGS. 2A-D, a standard adze end of a hallagan tool would engage the Firefighting Tool 100 at Firefighting Tool Wedge Slot 114 until reaching slightly less than the center point of the Firefighting Tool 100 because of the two interior protrusions within Firefighting Tool Wedge Slot 114. In another embodiment, the afore-mentioned two interior protrusions are absent and the Firefighting Tool Wedge Slot 114 passes entirely through the interior of the Firefighting Tool 100, forming a uniform cavity. In one embodiment, Firefighting Tool Wedge Slot 114 is shaped with an upper and lower flat or planar portion, in which each terminus forms a semicircular portion to connect the upper and lower portions. In another embodiment, the profile of the Firefighting Tool Wedge Slot 114 is rectangularly shaped. In another embodiment, the termini of the upper and lower portion of the Firefighting Tool Wedge Slot 114 angle toward one another to form a sideways V shape. In one embodiment, the Firefighting Tool Wedge Slot 114 extends towards the wedged-shaped end of the Firefighting Tool 100 past one or more of the transition points between the body and wedge portions of the Firefighting Tool 100, that is past one or both of Firefighting Tool Groove 120 and Firefighting Tool Wedge/Body Transition 122. In another embodiment, the Firefighting Tool Wedge Slot 114 does not extend into the wedged-shaped end of the Firefighting Tool 100 past either one or more of the transition points between the body and wedge portions of the Firefighting Tool 100.

In one embodiment, one or more edges of the Firefighting Tool 100 are rounded, such as Firefighting Tool Body Edge 142 and Firefighting Tool Wedge Prong Edge 113. In one embodiment, Firefighting Tool Groove 120 is of notch shape and traverses the entire width of Firefighting Tool 100. In one embodiment, the Firefighting Tool 100 may be manufactured using computer-numeric control (CNC) machining techniques. In one embodiment, the Firefighting Tool 100 is one of cast, forged and molded from metals or composites.

In one embodiment, Firefighting Tool 100 weighs between 14 ounces and 3 pounds. In a preferred embodiment, Firefighting Tool 100 weighs between 15 ounces and 2 pounds 9 ounces. In a most preferred embodiment, Firefighting Tool 100 weighs approximately 1 pound.

One of ordinary skill in the art will appreciate that embodiments of the present disclosure may be constructed of materials known to provide, or predictably manufactured to provide, the various aspects of the present disclosure. These materials may include, for example, high strength steel, case-hardened steel, stainless steel, titanium alloy, aluminum alloy, chromium alloy, and other metals or metal alloys capable of being used without failure repeated use as a firefighting tool.

In one embodiment, one or more surfaces of the Firefighting Tool 100 are roughed. For example, one or both surface of Firefighting Tool Groove 120 are roughened or textured.

One of ordinary skill in the art will appreciate that embodiments of the present disclosure as provided in FIGS. 1A-D may be used in applications other than firefighting. For example, in any application or situation in which destructive movement or opening is required, such as breaching of glass, removal of a vehicle's trim, and creating purchase points (i.e. opening points) for rescue tools such as hydraulic tools. The tool may be used, for example and without intending to limit the use, for prying, battering, penetrating, pulling, pushing, lifting, cutting, breaking, striking, dragging, door stop, hinge blocking, gas meter shut-off or turn-on, vehicle trim removal, glass breaching, door forcing, peel and peak operations, fire hydrant opening and closing and supporting firefighting and rescue operations.

In one embodiment, the tool is configured to fit within the front or rear pocket of a firefighter's pants. In one embodiment, the tool is configured to fit in a pocket of a firefighter's jacket. In one embodiment, the tool is of one-piece construction. In one embodiment, no dimension of the tool exceeds 8 inches. In one embodiment, the total weight of the tool does not exceed 2 pounds.

Without intending to limit the scope of the invention, FIGS. 4A-D depict one example construction of one embodiment of the invention in drawings each to scale. Dimensions are in inches.

Another embodiment of the multi-purpose fire-fighting tool is provided in FIGS. 5-9. Generally, the tool 100 of the embodiment of FIGS. 5-9 comprises connecting sleeve 210, handle 220, retaining washer 230, snap ring 240, socket 250, pin 260 and body two 270. Among other things, this embodiment of the tool 100 may be used without a halligan tool, includes a disconnecting handle to allow the overall tool to lie flat, and provides a handle which incorporates a fire hydrant wrench and a spanner feature. In one embodiment, at least one component of the tool comprises hardened aluminum, such as 7075 hardened aluminums, which provides a balance of relatively light weight and high strength.

With attention to FIGS. 5-9, connecting sleeve 210 comprises connecting sleeve first end 211, connecting sleeve second end 212 and connecting sleeve aperture 214. Connecting sleeve 210 is generally of cylindrical cross-section and configured to engage or interconnect with handle first end 221. Handle 220 comprises handle first end 221, handle second end 222 and handle aperture 224. Handle 220 is generally of cylindrical cross-section, and includes one or more sections of different cross-sectional diameter. In one alternate embodiment, handle 220 comprises an axial-axis bend in the mid-section. Handle first end 221 is of rectangular cross-section and includes an aperture 224 configured to fit within connecting sleeve 210 and body two second end 272, such that pin 260 fits through aligned body two pin aperture 275 and connecting sleeve aperture 214. In one embodiment, pin 260 is configured to extend approximately 0.2 inches on each side of body two pin aperture 275. Pin 260 may attach or engage the afore-mentioned aligned apertures in any of several ways, to include as an interference fit and with aid of a separate retaining clip fitted perpendicular to one end of the pin so as to no allow the pin 260 to disengage from a position in the aligned aperture. Handle 220 interconnects with socket 250 at aperture 254. Handle second end 222 is configured to axially engage retaining washer 230 and snap ring 240, wherein circularly-shaped handle second end 222 securely engages socket 250 by way of socket aperture 254, retaining washer 230 and snap ring 240. In one alternate embodiment, the circularly-shaped handle second end 222 threadably engages socket 250.

Figure 5A:
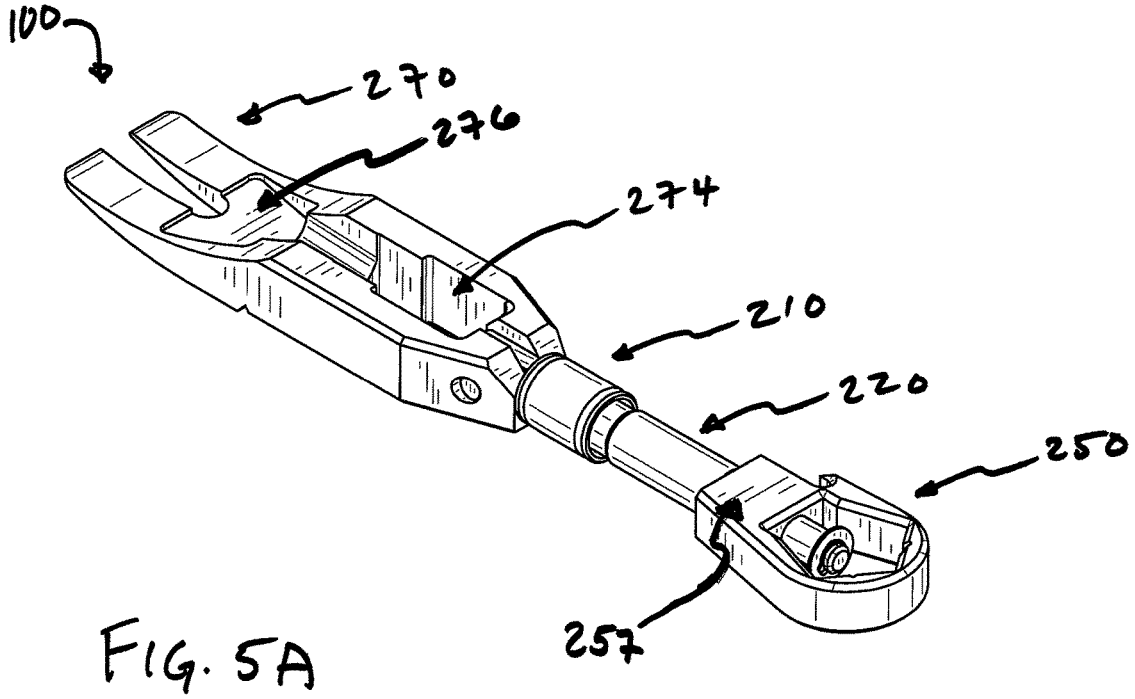
FIG. 5A depicts a left rear perspective view of the multi-use firefighting tool according to another embodiment of the present invention.
Figure 5B:
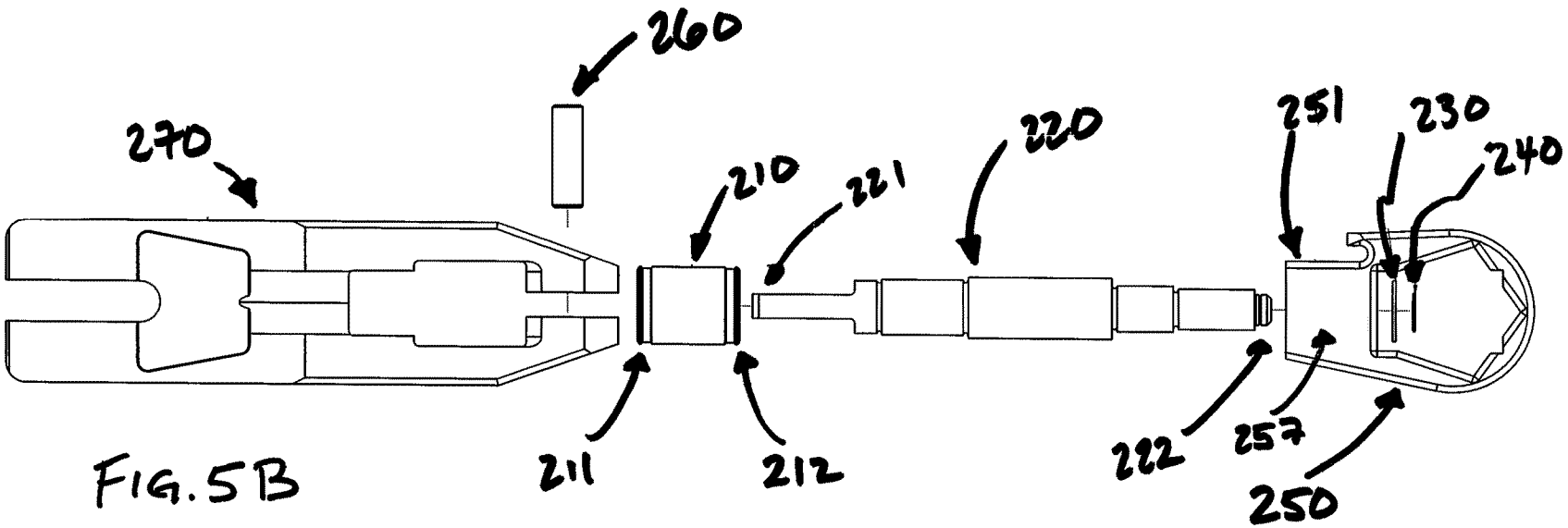
FIG. 5B depicts an exploded top view of the multi-use firefighting tool of FIG. 5A—the drawing is to scale.
Figure 6A:
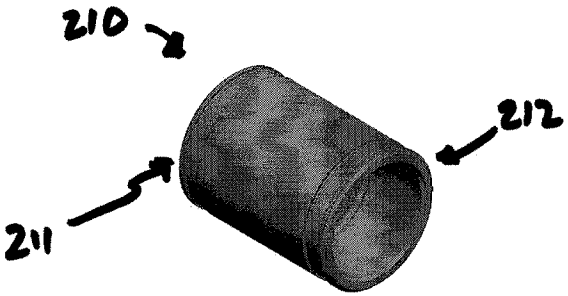
FIG. 6A depicts a right rear perspective view of the connecting sleeve component of the multi-use firefighting tool of FIG. 5A—the drawing is to scale—the drawing is to scale.
Figure 6C:
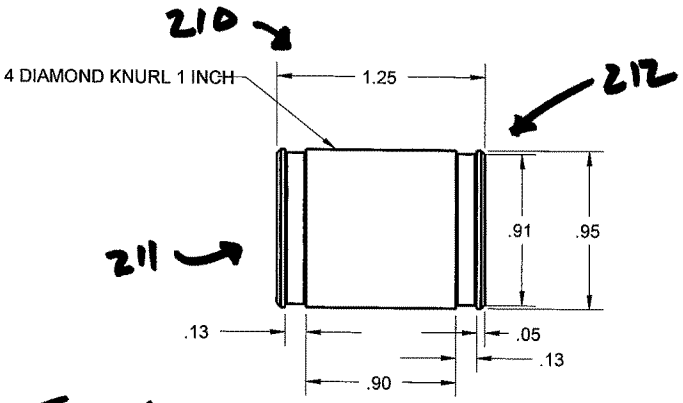
FIG. 6C depicts a top view of the connecting sleeve component of FIG. 6A—the drawing is to scale.
Figure 6B:
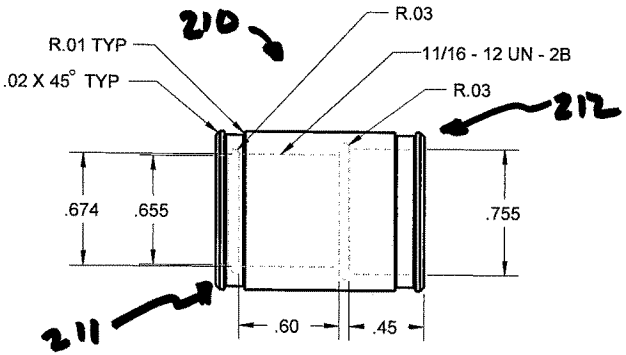
FIG. 6B depicts a left side view of the connecting sleeve component of FIG. 6A—the drawing is to scale.
Figure 7A:
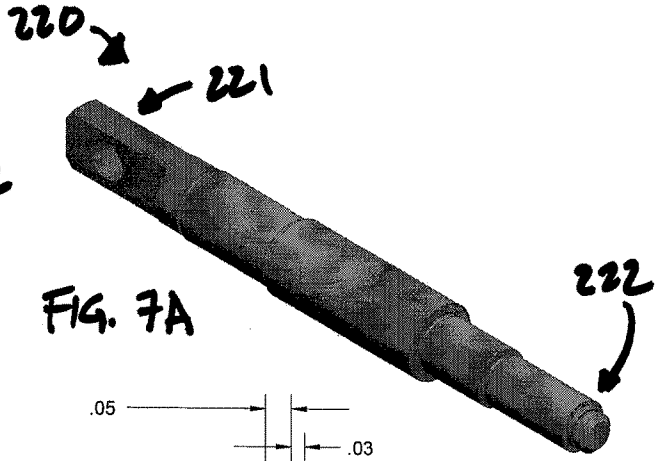
FIG. 7A depicts a right rear perspective view of the handle component of the multi-use firefighting tool of FIG. 5A—the drawing is to scale.
Figure 7D:
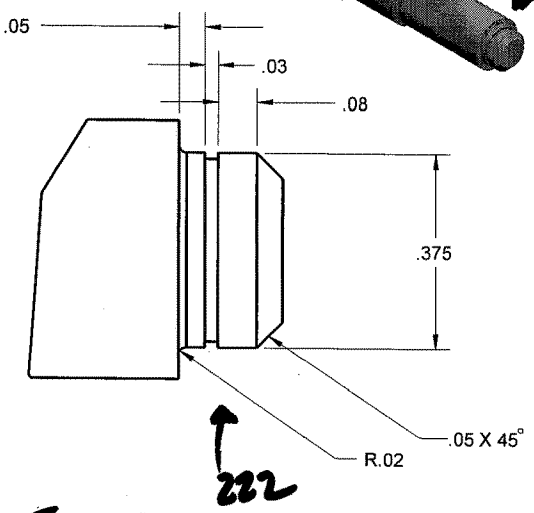
FIG. 7D is a detailed left side view of a portion of the handle component shown in FIG. 7C—the drawing is to scale.
Figure 7C:
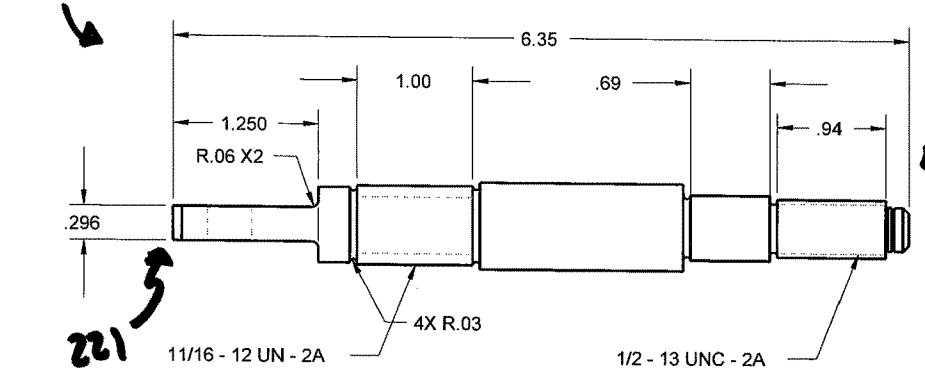
FIG. 7C depicts a top view of the handle component of FIG. 7A—the drawing is to scale.
Figure 7B:
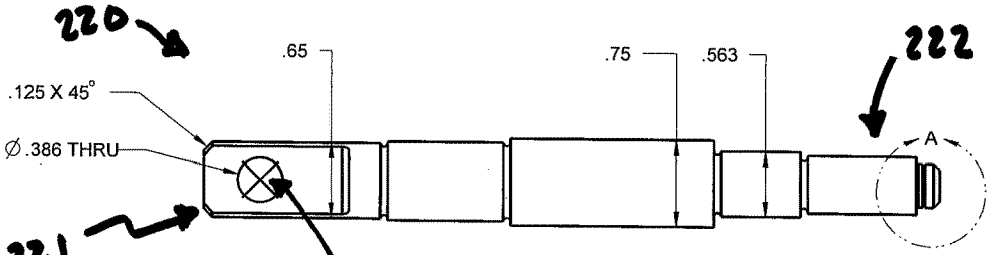
FIG. 7B depicts a left side view of the handle component of FIG. 7A—the drawing is to scale.
Figures 8A, 8B, 8C, 8D:
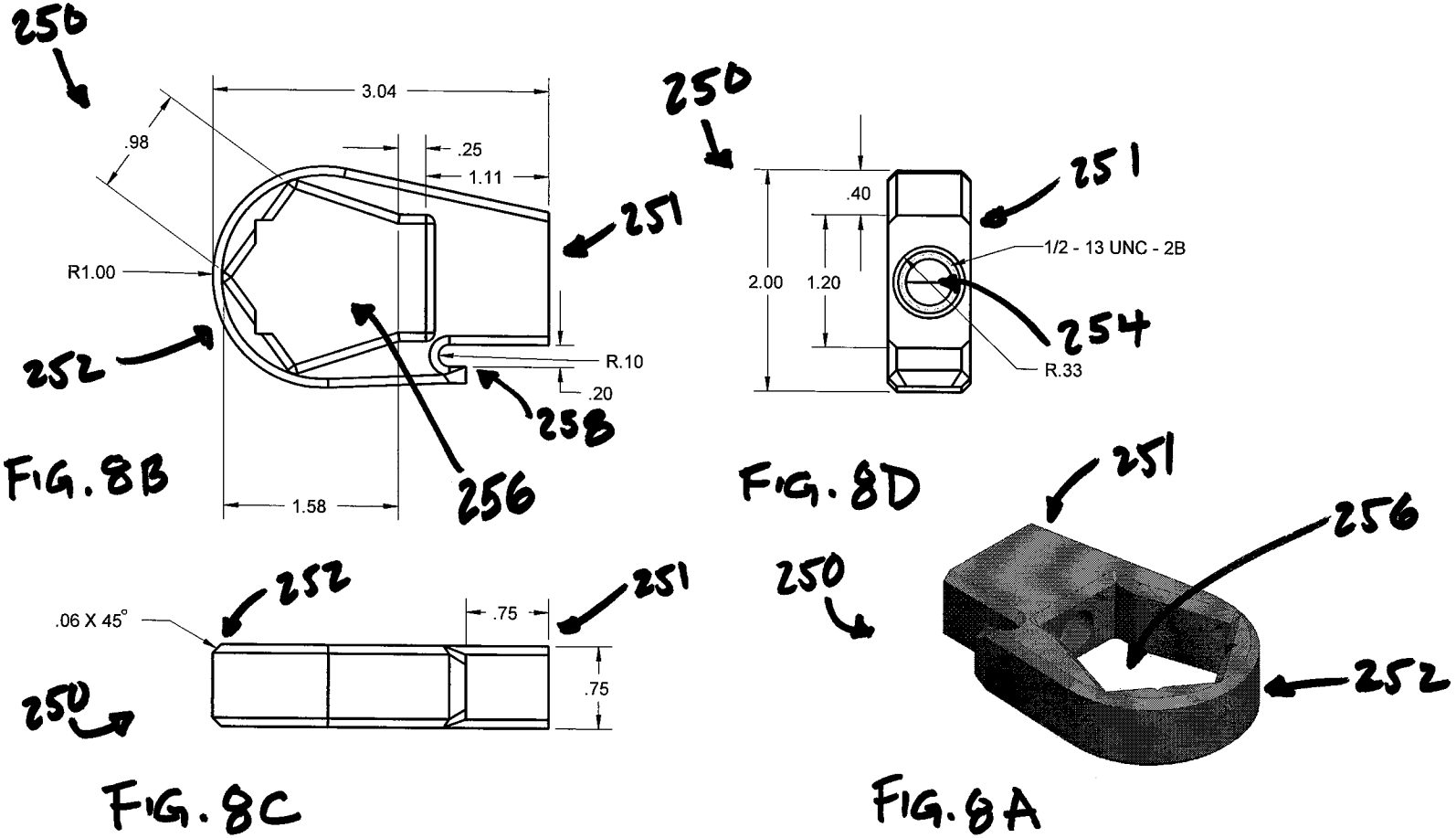
FIG. 8A depicts a right rear perspective view of the socket component of the multi-use firefighting tool of FIG. 5A—the drawing is to scale.
FIG. 8B depicts a left side view of the socket component of FIG. 8A—the drawing is to scale.
FIG. 8C depicts a top view of the socket component of FIG. 8A—the drawing is to scale.
FIG. 8D depicts a rear view of the socket component of FIG. 8A—the drawing is to scale.
Figures 9A, 9B, 9C, 9D:
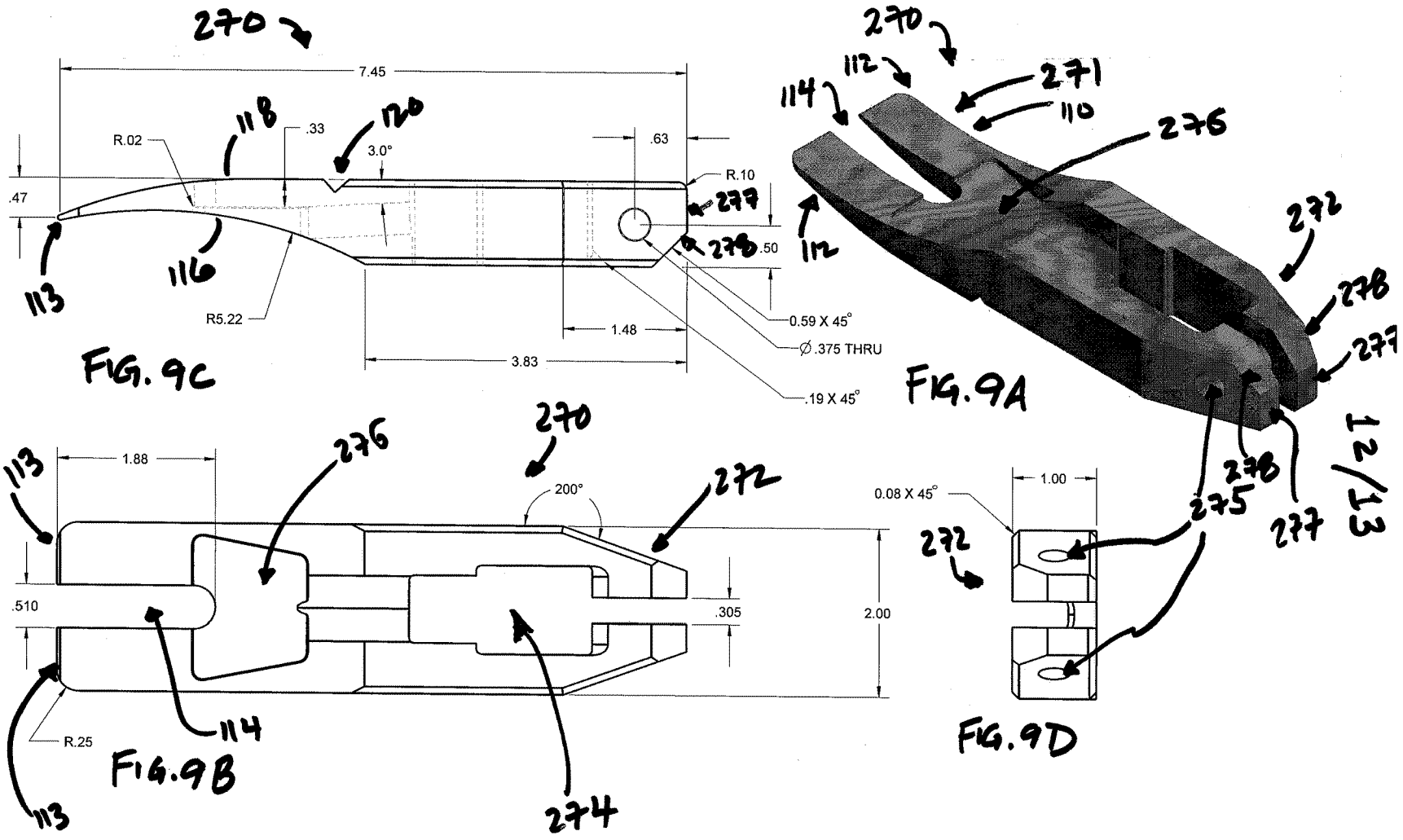
FIG. 9A depicts a right rear perspective view of the body component of the multi-use firefighting tool of FIG. 5A—the drawing is to scale.
FIG. 9B depicts a top view of the body component of FIG. 9A—the drawing is to scale.
FIG. 9C depicts a right side view of the body component of FIG. 9A—the drawing is to scale.
FIG. 9D depicts a rear view of the body component of FIG. 9A—the drawing is to scale.
Figure 9E:
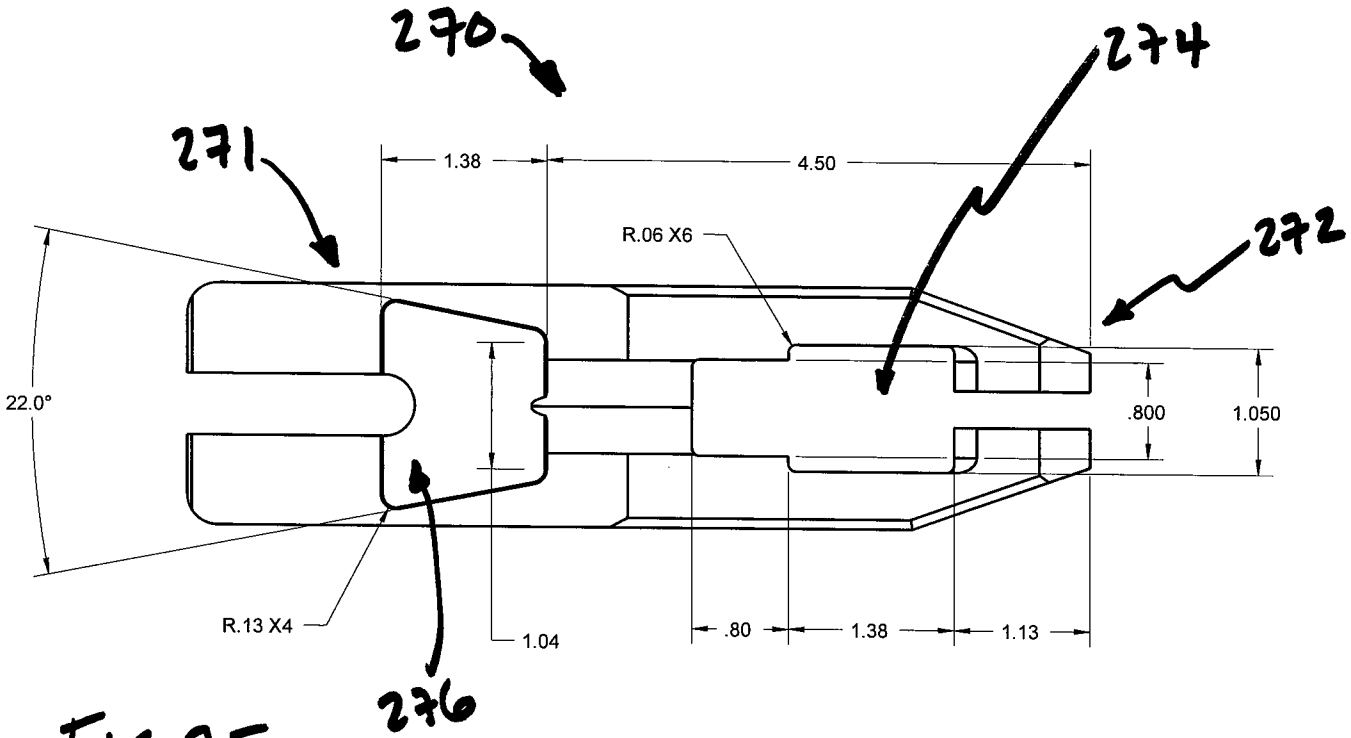
FIG. 9E depicts another top view of the body component of FIG. 9A—the drawing is to scale.

Socket 250 comprises socket first end 251, socket second end 252, socket aperture 254, socket pentagonal aperture 256, socket face 257 and socket spanner aperture 258. In one embodiment, when handle 220 is connected to socket 250, socket pentagonal aperture 256 generally is oriented in a face-up orientation along with body two aperture 274. In some embodiments, handle second end 222 extends into socket pentagonal aperture 256, as depicted in FIG. 5A. Socket pentagonal aperture 256 and/or socket spanner aperture 258 are configured to engage valves and operate as a valve opening tool; in one embodiment, socket pentagonal aperture 256 and/or socket spanner aperture 258 are configured to engage a valve of a fire hydrant. In one embodiment, socket 250 is devoid of the socket spanner aperture 258 component. In one embodiment, the socket spanner aperture 258 component is of alternate design or configuration, to include any known commercially-available socket spanner aperture 258 as used, for example, to engage a fire hydrant. In one embodiment, socket pentagonal aperture 256 generally forms a pentagonal-shaped interior. In one embodiment, socket pentagonal aperture 256 generally does not form a pentagonal-shaped interior but instead forms any alternate geometry which allows or enables engagement of the tool 100 with a valve of a fire hydrant.

Body two 270 comprises body two first end 271, body two second end 272, body two aperture 274, body two pin aperture 275, body two plateau 276, body two first face 277, body two second face 278 and body two third face 279. Generally, body two first end 271 comprises several features of the embodiment of the fire-fighting tool of FIGS. 1 and 2, such as wedge prong 112 with a pair of wedge prong edges 113, wedge slot 114, curved wedge first surface 116 and curved wedge second surface 118, and groove 120.

Body two aperture 274 is configured to engage and operate valves, such as those of a fire hydrant. Body two aperture 274 comprises a first aperture of rectangular dimension, one dimension of slightly more than 1 inch (e.g. 1.050 inch) to enable engagement or interconnection with, e.g., a valve configured with a linch square extension plug, and another dimension slightly more than 1⅜ inch (e.g. 1.380 inch), to enable engagement or interconnection with, e.g., a valve configured with a 1⅜ inch extension plug. See FIG. 9E. Body two aperture 274 further comprises a second aperture of square shape with side dimension slightly more than ¾ inch (e.g. 0.8 inch), to enable engagement or interconnection with, e.g., a valve configured with a ¾ inch extension plug.

The tool 100 of FIGS. 5-9 may operate in any of at least three states or positions. A first or open or flat position/state of tool 100 is as depicted in FIG. 5A, wherein connecting sleeve first end 221 abuts the body two second end 272 at body two first face 277. A second state of tool presents the body two 270 at approximately a 45 degree angle from the horizontal or with respect to the handle 220 and socket 250. This state is achieved by loosening the snap ring 240 so as to allow rotation, about the axis of pin 260, of the body two 270 in an upward or clockwise manner (upward or clockwise as depicted in FIG. 5A) such that connecting sleeve first end 221 abuts the body two second end 272 at body two second face 278. Snap ring 240 may then be tightened to provide a secure fit or secure interconnection between the body two 270 and the handle 220. In a third or closed state, the body two is rotated 180 degrees from horizontal such that the body two 270 lies substantially flat above the handle 220 and socket 250. This state presents a folded and flat tool 100 that is readily transported or stored. In the third of folded state of tool 100, body two plateau 276 engages or interconnects or contacts socket face 257. Other states are possible and are configured simply by rotating the body two 270 to a desired rotational position and clamping or securing the snap ring 240. In particular, e.g., the body two 270 may be rotated 90 degrees wherein connecting sleeve first end 221 abuts the body two second end 272 at body two third edge 279.

As will be appreciated, it would be possible to provide for some features of the inventions without providing others.

To provide further clarity to the Detailed Description provided herein in the associated drawings, the following list of components and associated numbering are provided as follows:

| # | Component |
|---|---|
| 100 | Firefighting Tool |
| 110 | Firefighting Tool Wedge |
| 112 | Firefighting Tool Wedge Prong |
| 113 | Firefighting Tool Wedge Prong Edge |
| 114 | Firefighting Tool Wedge Slot |
| 115 | Firefighting Tool Wedge Slot Distal Edge |
| 116 | Firefighting Tool Wedge First Surface |
| 118 | Firefighting Tool Wedge Second Surface |
| 120 | Firefighting Tool Groove |
| 122 | Firefighting Tool Wedge/Body Transition |
| 130 | Firefighting Tool Body |
| 132 | Firefighting Tool Body Vertical Aperture |
| 134 | Firefighting Tool Body Horizontal Cavity |
| 136 | Firefighting Tool Body First Surface |
| 138 | Firefighting Tool Body Second Surface |
| 140 | Firefighting Tool Body Lateral Surface |
| 142 | Firefighting Tool Body Edge |
| 150 | Firefighting Tool Body Face |
| 210 | Connecting Sleeve |
| 211 | Connecting Sleeve First End |
| 212 | Connecting Sleeve Second End |
| 214 | Connecting Sleeve Aperture |
| 220 | Handle |
| 221 | Handle First End |
| 222 | Handle Second End |
| 224 | Handle Aperture |
| 230 | Retaining Washer |
| 240 | Snap Ring |
| 250 | Socket |
| 251 | Socket First End |
| 252 | Socket Second End |
| 254 | Socket Aperture |
| 256 | Socket Pentagonal Aperture |
| 257 | Socket Face |
| 258 | Socket Spanner Aperture |
| 260 | Pin |
| 270 | Body Two |
| 271 | Body Two First End |
| 272 | Body Two Second End |
| 274 | Body Two Aperture |
| 275 | Body Two Pin Aperture |
| 276 | Body Two Plateau |
| 277 | Body Two First Face |
| 278 | Body Two Second Face |
| 279 | Body Two Third Face |

While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure. Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A firefighting tool comprising:

a body having a first end comprising a wedge and a second end comprising a slot and a horizontal aperture passing through the slot;

a handle comprising a first end comprising a handle aperture, the handle first end configured to interconnect with the slot wherein the handle aperture aligns with the horizontal aperture to enable a pin to fit within the aligned handle aperture and horizontal aperture; and a socket comprising a first end configured to interconnect with the second end of the handle and a second end configured with a pentagonal aperture.

2. The tool of claim 1, wherein the wedge terminates in a pair of prongs forming a wedge slot.

3. The tool of claim 1, wherein the pentagonal aperture is adapted to operate as a valve operating tool.

4. The tool of claim 1, further comprising a connecting sleeve configured to engage the handle first end.

5. The tool of claim 1, further comprising a retaining washer and a snap ring, each configured to engage the handle second end.

6. The tool of claim 1, wherein the handle first end is of rectangular cross-section.

7. The tool of claim 1, wherein the tool is manufactured of a high-strength material comprising high strength steel, case-hardened steel, titanium and beryllium copper.

8. The tool of claim 1, wherein the second end of the handle interconnects with the socket aperture by way of a snap ring.

9. The tool of claim 1, wherein the body comprises a vertical aperture between the first and second end.

10. The tool of claim 1, wherein the body may be configured in any of a flat state, an angled state, and a folded state relative to the socket.

11. The tool of claim 1, wherein the wedge comprises a symmetrical arcuate profile shape.

12. A firefighting tool, comprising:

a body having a first end configured with a wedge and a second end configured with a slot and a horizontal aperture passing through the slot;

a handle comprising a first end configured with a handle aperture and configured to interconnect with the slot, wherein when the handle aperture is in alignment with the horizontal aperture a pin fitted within the aligned handle aperture and horizontal aperture secures the handle with the body;

a socket comprising a first end configured to interconnect with the second end of the handle and a second end configured with a pentagonal aperture; and a connecting sleeve configured to engage the handle first end;

wherein the pentagonal aperture is adapted to operate as a valve operating tool.

13. The tool of claim 12, wherein the wedge terminates in a pair of prongs forming a forming a wedge slot, and wherein the body may be configured in any of a flat state, a 45 degree angled state, and a folded state relative to the socket.

14. The tool of claim 12, wherein the wedge comprises a symmetrical arcuate profile shape.

15. The tool of claim 12, wherein the second end of the handle interconnects with the socket aperture by way of a snap ring.

16. The tool of claim 12, wherein the tool is manufactured of a high-strength material comprising high strength steel, case-hardened steel, titanium and beryllium copper.

17. The tool of claim 12, wherein the handle first end is of rectangular cross-section.

18. The tool of claim 12, wherein the body may be configured in any of a flat state, an angled state, and a folded state relative to the socket.

19. The tool of claim 12, the body comprises a vertical aperture between the first and second end.

20. A method of using a firefighting tool, comprising:

providing a firefighting tool, the tool comprising: a body having a first end comprising a wedge and a second end comprising a slot and a horizontal aperture passing through the slot; a handle comprising a first end comprising a handle aperture, the handle first end configured to interconnect with the slot wherein the handle aperture aligns with the horizontal aperture to enable a pin to fit within the aligned handle aperture and horizontal aperture; and a socket comprising a first end configured to interconnect with the second end of the handle and a second end configured with a pentagonal aperture; and engaging an external surface with the firefighting tool assembly to at least one of force-entry, pry, wedge, strike, hammer, twist and destructively transfer energy.

21. The method of claim 20, the tool further comprising a connecting sleeve configured to engage the handle first end.

* * * * *